United States Patent [19]

Sengupta

[11] Patent Number: 4,629,359

[45] Date of Patent: Dec. 16, 1986

[54] POWER TROWEL

[75] Inventor: Amitava Sengupta, Hartford, Wis.

[73] Assignee: Wacker Corporation, Milwaukee, Wis.

[21] Appl. No.: 739,691

[22] Filed: May 31, 1985

[51] Int. Cl.[1] ..... E01C 19/42; E01C 19/44

[52] U.S. Cl. ..... 404/112; 403/224; 425/458; 16/112; 267/141; 173/162 H

[58] Field of Search ..... 404/112; 51/177; 403/224, 227; 425/456, 458; 267/141, 153; 16/111 R, 111 A, 112; 173/162 H; 248/291

[56] References Cited

U.S. PATENT DOCUMENTS

| | | | |
|---|---|---|---|
| 928,702 | 7/1909 | Rodman | 51/177 |
| 2,875,676 | 3/1959 | Thieme et al. | 404/112 |
| 2,882,806 | 4/1959 | Thieme et al. | 404/112 |
| 3,318,575 | 5/1967 | Hawkins et al. | 267/141 |
| 4,198,178 | 4/1980 | Carlstrom et al. | 404/112 |

*Primary Examiner*—Stephen J. Novosad

*Assistant Examiner*—John F. Letchford

*Attorney, Agent, or Firm*—James E. Nilles

[57] ABSTRACT

The power trowel of this invention has a chassis comprising a gear box and a prime mover and has a plurality of blades which engage a surface to be finished and which are driven by the prime mover, through the gear box, for substantially edgewise rotation about a vertical axis. An elongated handle for controlling movements of the machine across the surface has a pivotal connection to the chassis to be swingable up and down, but has an upper limit of such motion from which it is swingable downwardly. An elastically compressible shock absorber, confined between the handle and the chassis under compressive preload, tends to maintain the handle at that limit and is further compressed by downward force on the rear end of the handle. The center of gravity of the chassis is spaced forward of the vertical axis. Control of machine movements is minimally influenced by machine vibration, and is therefore more precise and less fatiguing.

3 Claims, 4 Drawing Figures

POWER TROWEL

FIELD OF THE INVENTION

This invention relates to power trowels of the type having a chassis comprising a prime mover and a gear box, a plurality of blades driven by the the prime mover through the gear box for substantially edgewise rotation about a vertical axis, which blades support the chassis and engage a surface to be finished, and an elongated handle normally projecting obliquely rearward and upward from the chassis and whereby the power trowel is guided when it is in operation; and the invention is more particularly concerned with improvements in such a power trowel whereby control of its movements across a surface to be finished is greatly facilitated.

BACKGROUND OF THE INVENTION

In a power trowel of the above described character, the entire weight of the machine is supported by the rotating blades, which are always engaged with the surface to be finished. A strong torque is therefore imposed upon the chassis that tends to rotate it in the direction opposite to that of blade rotation. The operator resists such torque by maintaining his grip upon the handle and controls the movements of the machine by applying appropriate vertical forces to the handle. With power trowels heretofore available, the connection between the handle and the chassis was a rigid one, and rather strong alternate upward and downward forces had to be applied to the handle during the course of a finishing operation. Upward force on the handle tended to tilt the chassis forward, causing the blade tips to bear most heavily against the surface at the fronts of their orbits so that the machine moved oppositely to the direction of the blade tips at the front of the orbit. Downward force on the handle caused the machine to move in the opposite sideward direction. With a moderate upward force on the handle the machine could be kept stationary.

The necessity for exerting rather large upward and downward forces on the handle was in itself fatiguing to the operator. In addition special difficulty was encountered in keeping the machine at a standstill, owing to the difficulty in maintaining the right amount of upward force while resisting the relatively high torque force on the handle.

These difficulties were aggravated by the substantial vibration that normally attends operation of a power trowel and results from irregularities in the freshly laid concrete surface that the blades engage. Such vibration causes abrupt up and down movements of the rear end of the handle relative to the operator's hands and thus imposes unintended vertical forces upon the handle that interfere with control of the machine.

Bearing in mind that a power trowel is a heavy and powerful machine, it will be apparent that, apart from the matter of operator fatigue, important safety considerations are involved in the ability to maintain positive control over its direction and speed of movement, and particularly in the ability to stop its movement accurately and to assuredly keep it stopped.

Heretofore these difficulties and disadvantages in the control of power trowels seem to have been accepted as inevitable, and apparently they were not recognized as undesirable. Accordingly, it has not been obvious that improvements could be made in the facility and accuracy with which a power trowel can be controlled, much less has it been obvious how to achieve such improvements.

SUMMARY OF THE INVENTION

It is a general object of this invention to provide a power trowel wherein relatively small upward and downward forces are applied to the handle to control the direction and rate of movement of the machine, and wherein only a very light "finger tip" upward force need be applied to the handle to maintain it at a standstill, so that the operator is not subjected to the fatigue of applying large alternate upward and downward forces.

It is also a general object of the invention to provide a power trowel of the character described that has a connection between its chassis and its handle which greatly improves the facility and precision with which the operator can control movements of the machine, eliminating the effects of small unintentional fluctuations in the vertical force applied to the handle, including those due to the vibrations of the machine as it works on a surface to be finished as well as fluctuations due to any inherent unsteadiness of the operator's arm muscles.

Thus it is a further general object of the invention to provide a power trowel which can be controlled more precisely and with less effort than prior such machines and which can therefore be operated more safely, especially in confined spaces.

A more specific object of the invention is to provide a power trowel that has a shock absorbing and vibration damping connection between its chassis and its handle that faciliates control of the movements of the machine across a surface to be finished, and wherein provision is also made for releasably locking the handle in an upright storage and transport position.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
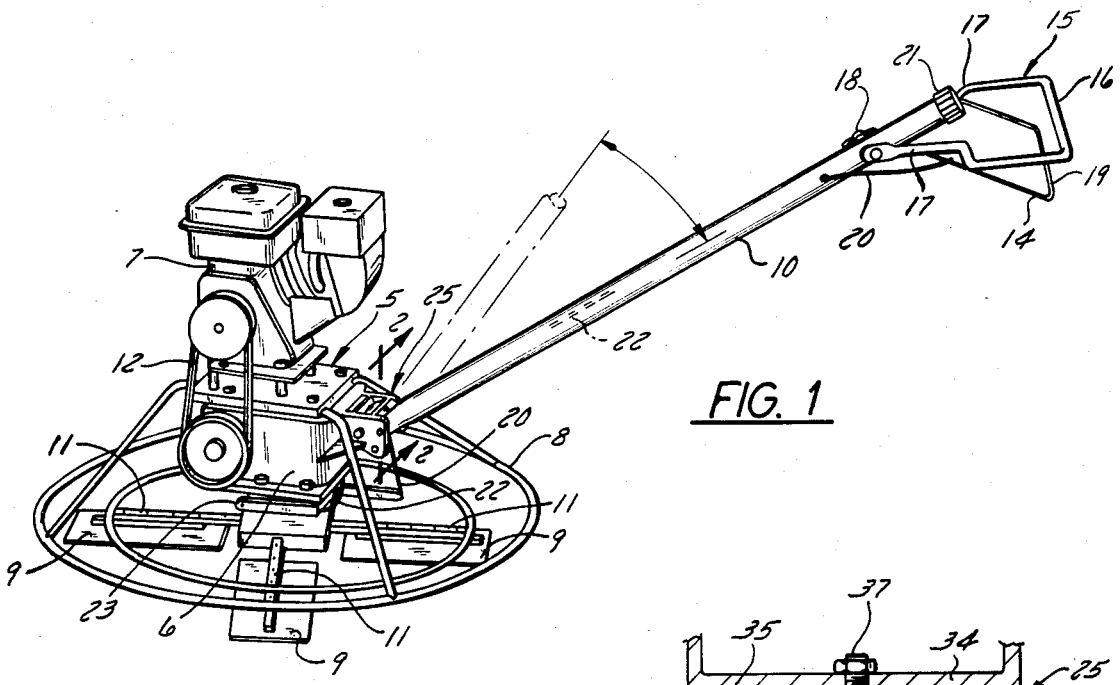
FIG. 1 is a side perspective view of a troweling machine embodying the principles of this invention.
Figure 4:
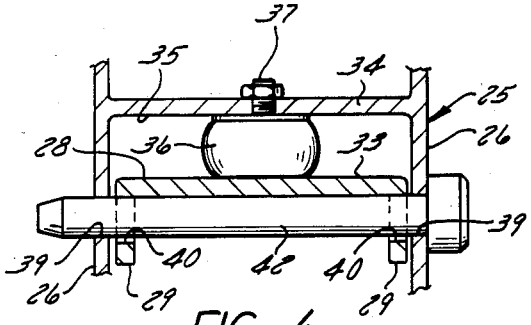
FIG. 4 is a view in section taken on the plane of the line 4—4 in FIG. 2.

A power trowel embodying the principles of this invention has a chassis 5 that comprises a gear box 6 upon which is mounted a prime mover 7 and which supports a guard 8. The machine also comprises a plurality of blades 9 that are driven from the prime mover, through the gear box, for substantially edgewise rotation about a vertical axis, and an elongated handle 10 which normally projects obliquely rearward and upward from the chassis.

There are usually either three blades 9 or four (four being shown in this case), each having a substantially flat bottom surface and being substantially rectangular, with its length radial to the vertical axis of rotation. Each of the blades 9 is secured to and underlies an arm 11 of a spider which is generally conventional and which is therefore not illustrated in detail. As is well known, the arms 11 of the spider extend radially relative to the vertical axis of blade rotation and they can be adjustingly swiveled in unison to bring the blades to a pitch attitude selected by the operator, wherein the bottom surfaces of the blades may be coplanar for finishing a fairly even surface or may be at a greater or lesser angle of incidence to the plane of their orbit for quickly working down irregularities in the surface to be finished.

The prime mover 7 is in this case illustrated as a small gasoline engine, although an electric motor could be used. It is mounted directly on top of the gear box 6, and in this case its crankshaft is connected with the input shaft of the gear box by means of a belt transmission 12. It will be understood that the machine has a known arrangement for controlling the rotational speed of the blades 9 and for causing the blades to stop rotating as soon as the operator releases his grip on a dead man control lever 14 at the rear of the handle 10.

The entire weight of the machine rests on the blades 9 as they rotate on a surface to be finished, and thus a substantially high torque in the direction opposite to that of blade rotation is imposed upon the handle 10, to be resisted by the operator with the advantage of the relatively long lever arm that the handle provides. The handle 10 proper comprises a relatively long straight and rigid tube. To its rear end is secured a gripping means that is heightwise adjustable for the operator's convenience. In this case the gripping means comprises a rigid bail 15 that has a substantially straight horizontally extending rear bight portion 16 and has at its front a pair of forwardly projecting legs 17 that lengthwise overlie opposite sides of the handle proper and are secured to it by means of a clamping screw 18.

The dead man control lever 14 is here shown as a U-shaped member that has forwardly projecting legs pivoted to the gripping means bail 15 and has a straight bight portion 19 that is swingable upwardly to an operative position alongside of the bight portion 16 of the bail 15. A Bowden cable 20 is connected between the dead man control lever 14 and a clutch in the gear box; or if the blades 9 are driven through a centrifugal clutch, then the dead man control lever 14 may be connected with the prime mover speed control (throttle or the like) to idle the prime mover upon release of the dead man control, thus disengaging the centrifugal clutch.

As is conventional, the control for adjusting blade pitch comprises a hand wheel 21 coaxially mounted at the upper end of the handle tube 10 and connected with a lead screw (not shown) that is housed in the handle tube. The lead screw, in turn, is connected by means of a tension cable 22 extending down through the handle tube with a lever 23 at the bottom of the chassis that comprises a part of the blade pitch adjusting mechanism of the spider.

It will be recognized that the power trowel of this invention is generally conventional with respect to the features described above. Turning now to features that are novel with the present invention, attention is first directed to the fact that the gear box 6, which is elongated from front to rear, is so arranged that its main mass is somewhat forward of the vertical axis of rotation of the blades 9 and that the prime mover 7 is mounted on the front portion of the gear box so that the center of gravity of the chassis is spaced a substantial distance in front of the vertical axis. This is in marked contrast to most heretofore conventional power trowels, wherein the prime mover and the gearbox have been arranged to establish the center of gravity of the machine as nearly as possible in coincidence with the rotational axis of the blades. Because of this forward location of the center of gravity of the chassis, the center of gravity of the machine as a whole, with the handle in its operating position, is spaced only a small distance to the rear of the rotational axis of the blades, and therefore the operator need apply only a "finger tip" upward force to the handle to maintain the machine stationary and only relatively light upward and downward forces to induce sideward movements.

Figure 3:
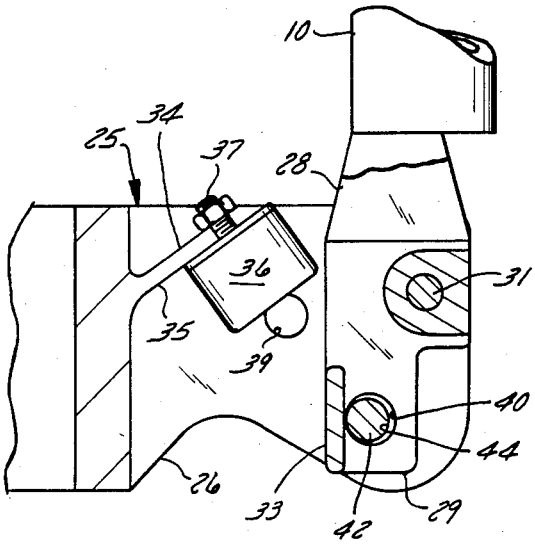
FIG. 3 is a view generally similar to FIG. 2 but showing the handle in its upright storage position.
Figure 2:
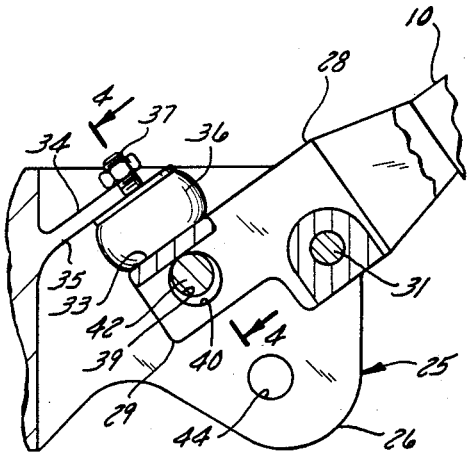
FIG. 2 is a fragmentary view in vertical section taken on the plane of the line 2—2 in FIG. 1, showing the handle in its operating position.

The downward forces that the operator imposes upon the rear end portion of the handle are transmitted to the chassis through a shock absorbing connection illustrated in FIG. 2. To provide for that connection there is a supporting bracket on the gear box, comprising a pair of plate-like edgewise upright and rearwardly projecting flanges 26 that are spaced apart laterally. To the front end of the handle tube 10 there is secured an inverted U-shaped pivot bracket 28, the opposite legs 29 of which are flatwise inwardly adjacent to the respective flanges 26 of the supporting bracket and are spaced to opposite sides of the handle tube 10. Through each of the pivot bracket legs 29 and its adjacent flange 25 of the supporting bracket there extends a bolt 31. The bolts 31, which are coaxial with one another, define a horizontal pivot axis which transversely intersects the axis of the handle tube 10 and about which the handle can be swung up and down between an upright storage position (FIG. 3) and the rearwardly and upwardly inclined normal operating position.

A portion of the pivot bracket 28 that is spaced to the front of the handle pivot axis when the handle is in its normal position defines a flat force transmitting surface 33 that extends transversely to the handle tube and faces obliquely forwardly and upwardly. On the supporting bracket 25 there is a rigid rearwardly projecting and laterally extending flange 34 which defines a flat downwardly and rearwardly obliquely facing force transmitting surface 35 that opposes the surface 33 on the pivot bracket. When the handle is in its operative position, a resilient shock absorber 36 is maintained under compressive preload between these two force transmitting surfaces 33 and 35.

In this case the shock absorber 36 is a circular buffer which is secured by means of its mounting stud 37 to the underside of the flange 34 on the supporting bracket, with its resilient cushion engageable by the flat surface 33 on the pivot bracket. When the machine is in use, the handle 10 is confined against swinging of its rear end upward beyond a predetermined limit at which the shock absorber 36 is preloaded, but the handle can be swung down from that limit position to increase the compressive force on the shock absorber. In this limit position, which can be considered its normal operating position, the handle is inclined rearward and upward from the chassis 5, and that position is defined by cooperating abutment means on the handle and on the chassis. In this case the abutment means comprises coaxial holes 39 in the flanges 26 of the supporting bracket 25 and larger diameter coaxial holes 40 in the legs of the pivot bracket 28, and further comprises a pin 42 which is closely slidably received in the smaller diameter holes 39 and extends through the larger diameter holes 40 in the pivot bracket.

The holes 39 and 40 are so located in relation to one another that the pin 42 maintains the shock absorber 36 compressively preloaded but nevertheless has sufficient play in the holes 40 so that the rear end of the handle can be swung down slightly relative to the chassis to further compress the shock absorber.

The above described connection between the handle and the chassis, in cooperation with the forward location of the center of gravity of the chassis, allows movements of the machine to be controlled with significantly lighter vertical forces on the handle than have heretofore been needed; and because of the resilient damping of vibrations that the shock absorber 36 affords, the machine responds faithfully to the operator's inputs without being unduly affected in its movements by irregularties in the surface being finished. As a result, the power trowel of this invention has a controllability much like that afforded by power steering in a motor vehicle, providing smoother and more precise control while demanding less effort from the operator.

The pin 42 can be readily inserted into or withdrawn from the aligned holes 39 and 40 if a small downward force is applied to the handle 10 behind its pivot axis, to thus free the pin 42 from the preload force of the shock absorber 36. With the pin 42 removed, the handle can be swung to its upright storage position shown in FIG. 3, wherein the holes 40 in the pivot bracket align with a second set of coaxial holes 44 in the flanges 26 of the supporting bracket. The pin 42 can then be inserted into these aligned holes 40 and 44 to readily releasably lock the handle in its upright storage position.

The shock absorber 36 can be of a standard commercial type having a Shore hardness in the range of 50°–80° Sh. Very satisfactory results have been obtained with a 40 mm diameter buffer having a hardness of about 55° Sh. Obviously two or more smaller shockmounts, mounted side-by-side, could be used instead of the one shockmount here shown.

From the foregoing description taken with the accompanying drawing it will be apparent that this invention provides simple and inexpensive improvements in a power trowel that provide for easier and more accurate control of the movements of the machine, thereby increasing the safety of its operation and reducing operator fatigue.

What is claimed as the invention is:

1. A power trowel for concrete finishing, comprising a chassis having a gear box and a prime mover, a plurality of blades which support the entire weight of the chassis by their engagement with a surface to be finished and which are driven by the prime mover through the gear box for substantially edgewise rotation about a vertical axis which is in fixed relation to the chassis, and an elongated handle that normally projects obliquely upward and rearward from the chassis and provides for control of the blades, said power trowel being characterized by:

A. said gear box and said prime mover being arranged to dispose the center of gravity of the chassis in forwardly spaced relation to said vertical axis;

B. cooperating connection means on the chassis and on the handle defining a horizontal pivot axis about which the handle is swingable up and down relative to the chassis and which is spaced behind said vertical axis;

C. rigid means fixed on the chassis and on the handle, respectively, defining opposing force transmitting surfaces, (1) said force transmitting surface on the handle facing substantially upward and being in forwardly spaced relation to said pivot axis, and (2) said force transmitting surface on the chassis facing substantially downward;

D. a resiliently compressible shock absorber fixed on one of said force transmitting surfaces to be compressively engaged by the other one; and E. cooperating abutment means on the chassis and on the handle, spaced from said pivot axis, arranged to define a limit of upward movement of the rear end of the handle relative to the chassis at which said shock absorber is under compressive preload but to permit downward movement of the rear end of the handle from said limit whereby compressive force on the shock absorber is increased.

2. The power trowel of claim 1 wherein said abutment means comprises a hole in the chassis and a hole in the handle, one of said holes having a larger diameter than the other, and further comprises a bolt which is axially removably received in said holes and fits said one hole with substantial radial play, further characterized by:

a second hole in the chassis which is aligned with said hole in the handle when the handle is in an upright position and in which said bolt is receivable to cooperate with said hole in the handle for releasably retaining the handle in said upright position.

3. A power trowel for concrete finishing, comprising a chassis having a gear box and a prime mover, a plurality of blades which support the entire weight of the chassis by their engagement with a surface to be finished and which are driven by the prime mover through the gear box for substantially edgewise rotation about a vertical axis which is in fixed relation to the chassis, and an elongated handle which has near a front end thereof a connection with a rear portion of the chassis and which provides for control of the movements of the power trowel across a surface engaged by the blades, said power trowel being characterized by:

A. said gear box and said prime mover being arranged to dispose the center of gravity of the chassis in forwardly spaced relation to said vertical axis;

B. said connection between the handle and the chassis being arranged to define a horizontal pivot axis which is spaced to the rear of said vertical axis and about which the handle is swingable up and down relative to the chassis;

C. cooperating abutment means on the handle and on the chassis defining an upper limit of swinging motion of the handle at which it projects obliquely rearwardly and upwardly from the chassis and from which it is swingable downwardly;

D. a resiliently compressible shock absorber; and

E. opposing surfaces on the handle and on the chassis, respectively, that are spaced from said pivot axis and between which said shock absorber is confined under a compressive preload that tends to maintain the handle at its upper limit of swinging motion and whereby downward force on the rear of the handle further compresses the shock absorber in imposing a tilting force upon the chassis through it.

* * * * *